US006404405B2

(12) United States Patent
Wanat

(10) Patent No.: US 6,404,405 B2
(45) Date of Patent: Jun. 11, 2002

(54) RELEASABLE MOUNTING FOR DISH SATELLITE ANTENNA

(76) Inventor: Mitchell Wanat, St. Peter's Church, 135 N. Main St., Concord, NH (US) 03301

( * ) Notice: Subject to any disclaimer, the term of this patent is extended or adjusted under 35 U.S.C. 154(b) by 0 days.

(21) Appl. No.: 09/882,698

(22) Filed: Jun. 14, 2001

Related U.S. Application Data

(60) Provisional application No. 60/218,425, filed on Jul. 14, 2000.

(51) Int. Cl.[7] ..... H01Q 1/12; H01Q 3/02
(52) U.S. Cl. ..... 343/892; 343/882
(58) Field of Search ..... 343/878, 880, 343/882, 892, 890

(56) References Cited

U.S. PATENT DOCUMENTS 5,526,010 A * 6/1996 Plunk ..... 343/882
5,707,033 A * 1/1998 Holt et al. ..... 343/882
5,982,340 A * 11/1999 Troche ..... 343/882
6,037,913 A * 3/2000 Johnson ..... 343/882

* cited by examiner

*Primary Examiner*—Don Wong
*Assistant Examiner*—Hoang Nguyen
(74) *Attorney, Agent, or Firm*—William B. Ritchie

(57) ABSTRACT

An apparatus for mounting a satellite dish having a mounting bracket in a window jam opening for a window frame with no physical intervention in the frame casing or jams. A mounting board having a length corresponding to the width of the window jam opening and having a width corresponding to the width of the mounting bracket is provided. At least one tensioning member rigidly is connected to said mounting board such that tensioning the tensioning member releasably fastens said mounting board within the window jam opening. In the preferred embodiment, two tensioning members are provided. The apparatus is positioned on the outside of the window. The window can be opened and closed without interference from said apparatus. The mounted board features at least one slot such that water is prevented from accumulating behind said mounting board and the window and wherein a cable from the dish may be inserted therethrough. The apparatus can be fabricated using readily available materials and is very inexpensive to produce. The apparatus enables the satellite dish to be installed from inside the building. It also is ideal for apartment dwellers in that the apparatus requires no holes to be placed in building yet provides a sturdy alternative to conventional mounting methods.

12 Claims, 3 Drawing Sheets

RELEASABLE MOUNTING FOR DISH SATELLITE ANTENNA

This application claims benefit of Prov. No. 60/218,425 filed Jul. 14, 2000

FIELD OF THE INVENTION

The invention relates to the field of apparatus for mounting a dish satellite antenna, in particular, mounting a dish satellite antenna in a window frame with no physical intervention in the frame casing or jams.

BACKGROUND OF THE INVENTION

The first generation of dish satellite antennae were so large and heavy that they had to be mounted on the ground. However, since the new version of this type of antenna typically weighs about ten pounds being made mostly of plastic with some metal parts and has a diameter of only about 20 inches, non-ground installations are now preferred. Due to the substantial popularity of such devices, they have become almost as common as the old style "clothesline" antenna dating back to the 50's.

Due to their small size and weight, it is now practical to install the present units on a roof, the side of a dwelling or on a chimney. U.S. Pat. No. 5,982,340 discloses a mounting device that is intended to mount a satellite antenna though a window in a building. However, this device is designed to be fastened to the building with the fastening mechanism inside the structure. This device also requires placing screws or bolt holes in the dwelling which may be prohibited by the building owner. While one alternative provides for fastening the structure without screws or bolts, an extremely awkward floor to ceiling anchoring arrangement is used instead, thus interfering with the total use of the room. Further, since the anchoring structure is inside the building and dish is desired to be placed on the outside, the normal open and closing of the window or screen is disrupted.

A mounting structure that is easily installable without requiring the insertion of bolts or screws in the building, that is capable of mounting a dish on the outside of standard windows, including those having brick jams, that can be removed without causing damage to the structure, that permits the dish to be mounted from inside the building on an floor irrespective of that floor's distance above the ground, and that permits normal operation of the window and/or screen is not taught in the prior art.

SUMMARY OF THE INVENTION

The invention is an apparatus for mounting a satellite dish having a mounting bracket in a window jam opening for a window. A mounting board having a length corresponding to the width of the window jam opening and having a width corresponding to the width of the mounting bracket is provided. The mounting board may include side accordion sections to cover the entire width of the window jam. At least one tensioning member rigidly is connected to said mounting board such that tensioning said at least one tensioning member releasably fastens said mounting board within the window jam opening. The apparatus is positioned on the outside of the window. The window can be opened and closed without interference from said apparatus. The mounted board features at least one slot such that water is prevented from accumulating behind said mounting board and the window and wherein a cable from the dish may be inserted therethrough.

Therefore, it is an aspect of the invention to provide a releasable satellite dish mounting apparatus that can be mounted on a building window from inside the structure yet have the entire mounting apparatus be outside the structure.

It is another aspect of the invention to provide a releasable satellite dish mounting apparatus that can be mounted without the use of screws, bolts, or other fasteners which make holes in the mounting surface.

It is still another aspect of the invention to provide a releasable satellite dish mounting apparatus that is inexpensive to manufacture and be easily fabricated using readily available components.

Another aspect of the invention is to provide a releasable satellite dish mounting apparatus that use with apartment buildings, particularly apartment buildings having brick window jams.

Another aspect of the invention is to provide a releasable satellite dish mounting apparatus that can be used with double hung, or sliding windows without interfering with the normal operation of the window.

Still another aspect of the invention to provide a releasable satellite dish mounting apparatus that can be used with standard wood window jams by using a reinforcing member for windows that may lack the dimensional stability necessitated by the tensioning members.

Still another aspect of the invention is to provide a releasable satellite dish mounting apparatus that be installed from inside a building on a window irrespective of the particular floor that the window is located.

Another aspect of the invention is to provide a releasable satellite dish mounting apparatus that can be easily removed and can be taken to a different location.

Finally, it is an aspect of the invention to provide a releasable satellite dish mounting apparatus that enables the satellite to function in accordance to the manufacturer's recommendations.

DETAILED DESCRIPTION OF THE INVENTION

Figure 1:
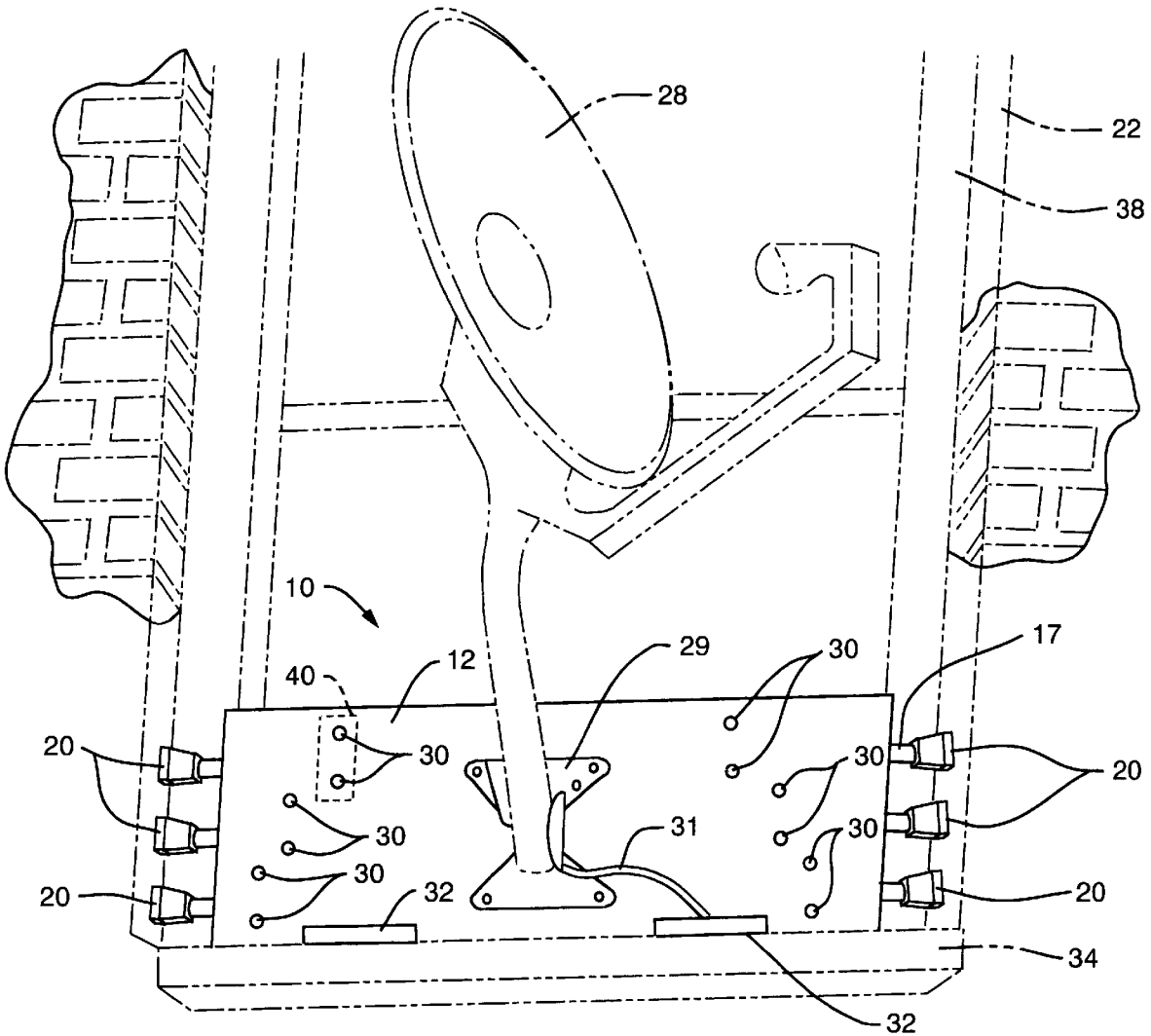
FIG. 1 is an isometric view of the invention installed in a typical window.
Figure 2:
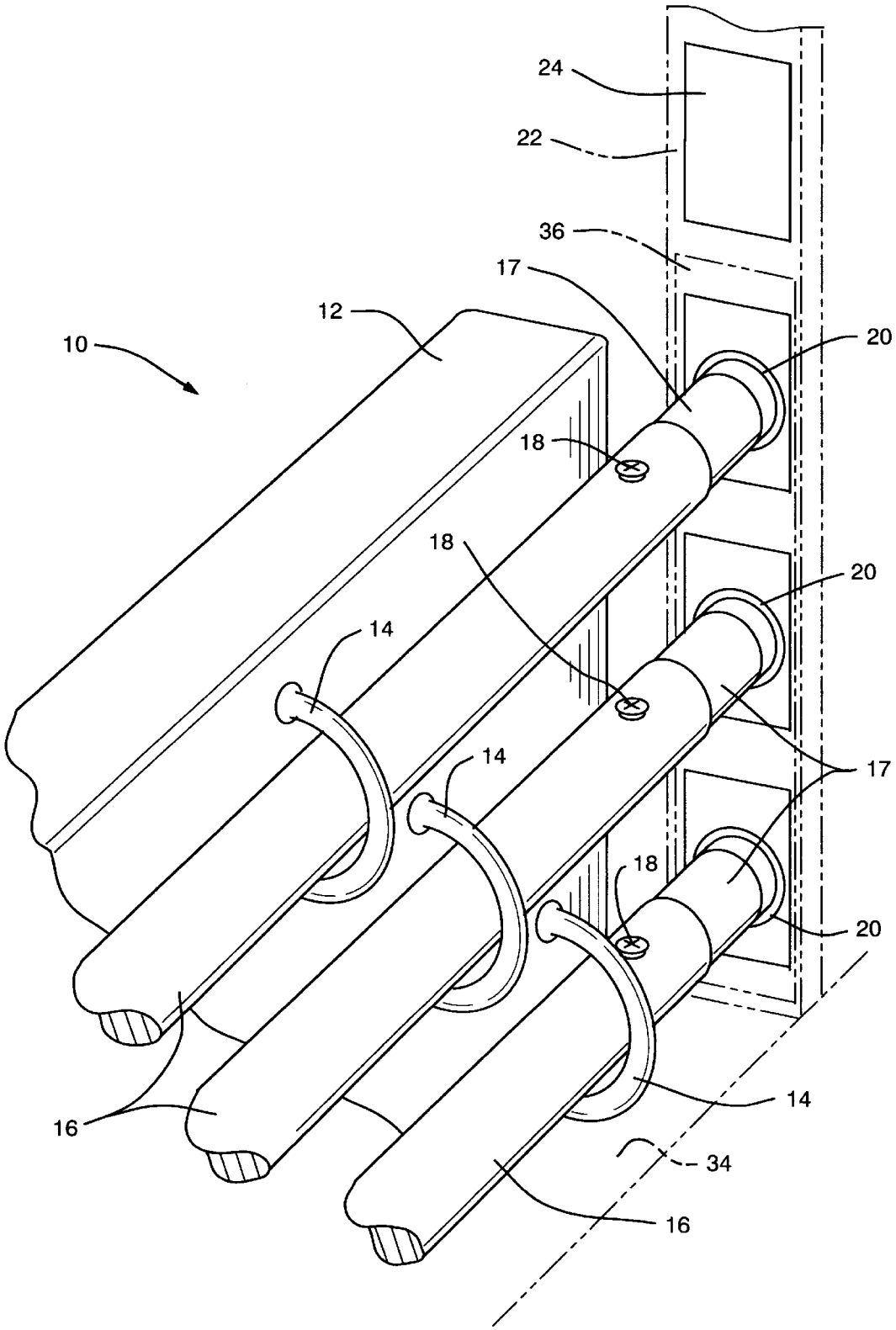
FIG. 2 is a detailed view of the invention viewed from inside the window shown in FIG. 1.

As shown in FIGS. 1 and 2, invention 10 is installed in a brick window opening such that dish 28 is mounted on the outside of the building. Dish 28, a typical small footprint satellite antenna, well known in the art, is fastened to mounting board 12 using the standard mounting bracket 29 supplied with dish 28. Mounting board 12 sits substantially flush on sill 34. This improves the stability of the unit does not require any permanent attachment fasteners such as screws to be inserted into sill 34.

Mounting board 12 is provided with slots 32 which prevent water from building up behind mounting 12. Slots 32 also serve to enable cable 31 to enter the building. Mounting board 12 is preferable made from wood; however, other materials can also be used. The inventor has found that the use of a 2 by 12 framing member, painted to protect the wood and improve the appearance of the unit, is suitable for manufacturing mounting board 12. The length and width of mounting board 12 are not critical. However, mounting board 12 must sufficiently wide so that bracket 29 has enough room to permit it to be mounted as well as a plurality of tensioning members 16. Further, the length of mounting board 12 is also not critical but must be sufficiently long such the two pairs of mounting U-bolts fastening each tensioning member 16 to mounting board 12 have sufficient distance between them to prevent tensioning member 16 from twisting relative to mounting board 12. Of course, the maximum length of mounting board 12 is dictated by the width of the window opening that apparatus is to be mounted.

The preferred model shown has been tested by the inventor in actual use and found that the despite experiencing adverse weather conditions such as high winds, heavy rains, below freezing temperatures, snow, and even summer heat, the apparatus remains securely fastened and the antenna functions perfectly.

Attached to the window side of mounting board 12 are shown three tensioning members 16. Each tensioning member 16 is preferably attached to mounting board 12 by a pair of U-bolts 14 which are secured to mounting board 12 via nuts 30. To prevent U-bolts 14 from pulling nuts 30 into mounting board 12, backing plate 40 (shown in dotted line in FIG. 2) can be used. However, extra reinforcing in the mounting area for tensioning members 16 could also be manufactured in place, especially an extruded mounting board 12 were used. While the use of U-bolts is preferred, other methods of attaching tensioning member 16 to mounting board 12 that are well known in the art, such as straps, would serve equally as well.

Each tensioning member 16 is preferably an adjustable mechanism that uses a screw type of expansion structure well known in the art such as closet poles, shower curtain rods, chin-up bars, etc. In this type of apparatus, inner member 17 is rotated or otherwise extend relative the rest of the apparatus, thus tightening the apparatus between two opposing surfaces. As shown, when tightened, feet 20 are positioned against opposing jams. In this case, tensioning member 16 is tightened by turning inner member 17 until feet 20 are securely tensioned against window jam 22. Feet 22 are typically rubber or other resilient material to provide a non-slip contact in the event that the tensioning force provided by tensioning member 16 is not perfectly perpendicular to the contact surface, in this case, jam 22. Thus, the length of tensioning member 16, while can be highly variable, owing to large adjustment capability of such structures, must be sufficient long to bridge the jam to jam distance of the opening when tensioning member 16 is in its open, tensioned position.

While a particular type of tensioning member 16 is shown, substituting another type that is capable of exerting the same force to holding mounting board 12 firmly in place would be equally suitable. For example, a security bar such as one manufactured by MASTERLOCK, available in the commercial market as model number 251 D, may be used for tensioning member 16. This arrangement features two tubes which can be moved relative to each other to a desired length. A lever locking mechanism then locks the tubes into place in window jam 22. Further, the portion of tension member 16 that is attached to mounting board 12 is preferably cylindrical as shown. However, it could also have a rectangular cross section if desired in order to provide an alternative method of mounting tension member 16 to mounting board 12.

Once securely in position, locking screw 18 is tightened to prevent tensioning member from loosening until invention 10 is to be removed. Note that the unit is fastened to the building without need for inserting holes in the structure and without interfering with the normal operation of the window 38.

It is preferable that three such tensioning members 16 are used, however, two or four or more could also be utilized. It is also possible to use a single tensioning member 16 in the position occupied by the middle tensioning member 16, providing the tensioning mechanism can be sufficient tightened and such that the force provided by that tensioning member is distributed over a greater area than that provided by a single foot 20. For example, a jack-type tool, well known in the art, which is used by fire fighters or police officers to spring the jams on a locked door so that it can be opened, will provide more than enough force. As long as foot 20 of the middle tensioning member 16 was correspondingly enlarged so that it contacted jam 22 over the area now shown occupied by top foot 20 and bottom foot 20, mounting board 12 would be held firmly in place.

Figure 3:
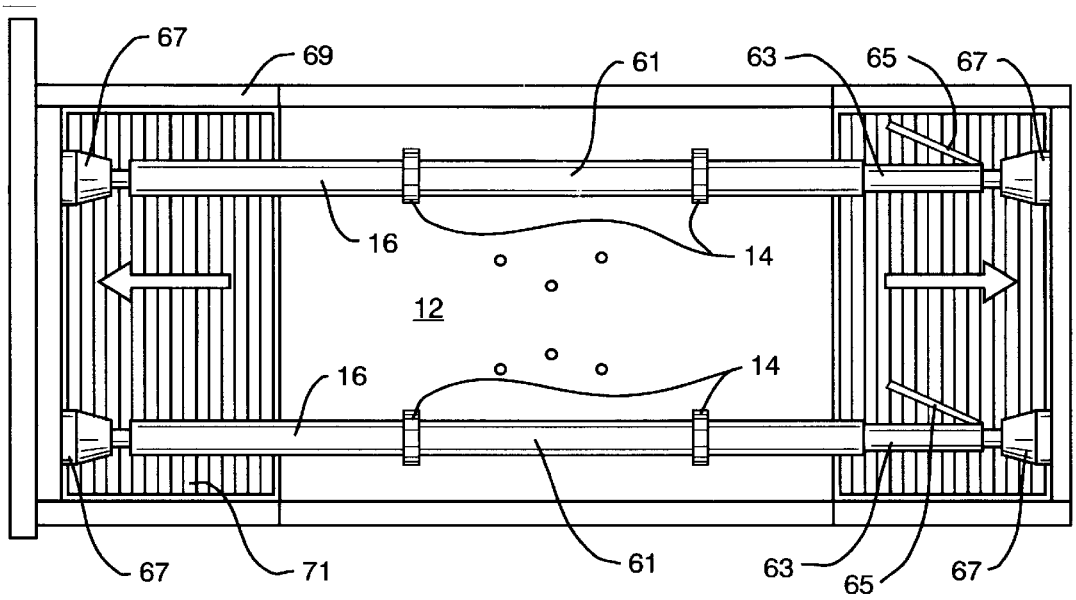
FIG. 3 is a rear view of an alternative embodiment of the invention.

FIG. 3 depicts an alternative embodiment of the present invention. In this embodiment, the length of mounting board 12 does not fill the entire width of the window. Attached to each end of mounting board 12 are extenders 69. Extenders 69 may be slid across the open space between the window jam and mounting board 12. Attached to extenders 69 are accordion sections 71. Accordion sections 71 are well known in the art, being similar to accordion sections commonly found on window mounted air conditioner units. When extenders 69 are extended, accordion sections 71 block any open space between the window jam and mounting board 12.

At least one tensioning member 16 is included. In FIG. 3 two tensioning members 16 are shown secured to mounting board 12 by U-bolts 14. Tensioning member 16 includes shaft 61. Tube 63, which is dimensioned to fit inside shaft 61, is moved relative to shaft 61 to obtain the desired length of tensioning member 16. Tube 63 is locked into place by lever locking mechanism 65 so that feet 67 fit secure against the window jam. The preferred locking arrangement is the one described above as made by MASTERLOCK. However, other locking arrangements providing the same degree of security and fastening ease could also be used.

Figure 4:
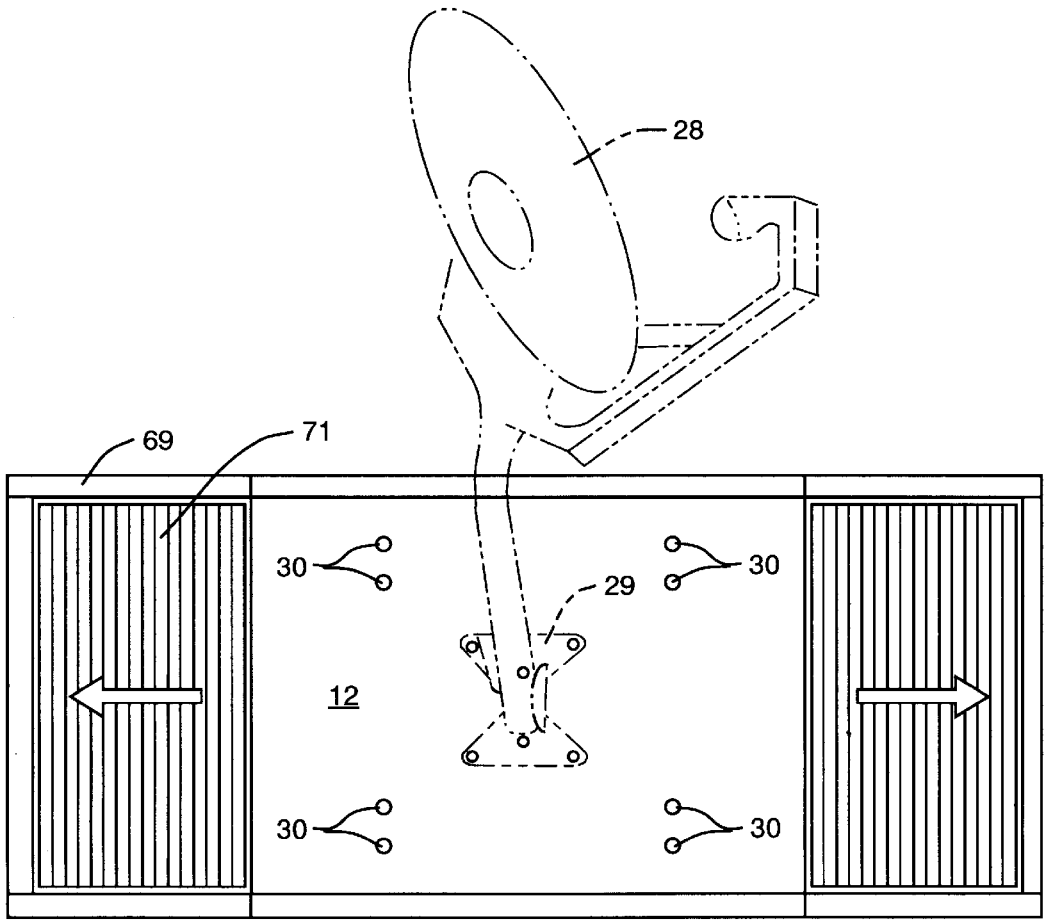
FIG. 4 is an isometric view of the embodiment of the invention shown in FIG. 3.

FIG. 4 displays the reverse side of the embodiment shown in FIG. 3. Dish 28 is secured to mounting board 12 by mounting bracket 29. Nuts 30 secure U-bolts 14 to mounting board 12. Extenders 69, located on either side of mounting board 12, movably extend beyond mounting board 12 to a desired length, preferably all the way to the window jam. Accordion sections 71 are attached to extenders 69 and occupy the space between mounting board 12 and the window jam.

Window 38 is depicted as a typical double-hung, one over one (one light above the other), however, other type of windows such as sliders will work equally as well. Also, when used with brick 24 to provide jams 22, there is no need for reinforcing the jam 22 to prevent tensioning members 16 from over stressing the structure. However, invention 10 can be used with wood jams by insertion of reinforcing plate 36 (showing in outline in FIG. 2). Reinforcing plate 36 is shown as being substantially smaller than the area of jam 22, however, depending on the degree of support required, plate 36 could be enlarged to cover the entire area of jam 22, thus spreading the force exhibited by tensioning members 16 over the entire surface of jam 22. Plate 36 may be fabricated from wood, plastic, or to provide extra strength, metal could be used.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An apparatus for mounting a satellite dish having a mounting bracket with a width in a window jam opening with a width for a window, said apparatus comprising:

a mounting board having a length corresponding to the width of the window jam opening and having a width corresponding to the width of the mounting bracket;

at least one tensioning member rigidly connected to said mounting board such that tensioning said at least one tensioning member releasably fastens said mounting board within the window jam opening such that said apparatus is positioned on the outside of the window and wherein the window can opened and closed without interference from said apparatus when the satellite dish is mounted on said mounting fit board via the mounting bracket.

2. The apparatus of claim 1 wherein said mounting board further comprises at least one slot such that water is prevented from accumulating behind said mounting board and the window and wherein a cable from the dish may be inserted therethrough.

3. The apparatus of claim 1 wherein said at least one tensioning member is connected to said mounting board via U-bolts.

4. The apparatus of claim 1 further comprising three tensioning members.

5. The apparatus of claim 4 wherein all three tensioning members essentially identical.

6. The apparatus of claim 4 wherein at least two tensioning members are a different type from one another.

7. The apparatus of claim 1 further comprising a pair of jam supports with each jam support associated with one side of the jam and wherein said jam supports are positioned between one end of said tensioning member and its corresponding window jam.

8. An apparatus for mounting a satellite dish having a mounting bracket with a width in a window jam opening with a width for a window, said apparatus comprising:

a mounting board having a length shorter than a corresponding width of the window jam and having a width corresponding to the width of the mounting bracket;

at least one tensioning member rigidly connected to said mounting board such that tensioning said at least one tensioning member releasably fastens said mounting board within the window jam opening such that said apparatus is releasably mounted within the window jam when the satellite dish is mounted in said mounting board via said mounting bracket.

9. The apparatus as claimed in claim 8 further comprising at least one accordion section attached to said mounting board, wherein said at least one accordion section is dimensioned to slidably extend from said mounting board to said window jam.

10. The apparatus as claimed in claim 9 further comprising two accordion sections attached to opposing ends of said mounting board.

11. The apparatus as claimed in claim 10 further comprising two substantially identical tensioning members.

12. The apparatus as claimed in claim 8 further comprising three substantially identical tensioning members.

* * * * *